US005444923A

United States Patent [19]

Romm et al.

[11] Patent Number: 5,444,923

[45] Date of Patent: Aug. 29, 1995

[54] QUICK CURE EXHAUST MANIFOLD

[75] Inventors: Douglas W. Romm; Larry W. Nye, both of Sherman, Tex.; Michael R. Head, Colbert, Okla.

[73] Assignee: Texas Instruments Incorporated, Dallas, Tex.

[21] Appl. No.: 47,592

[22] Filed: Apr. 13, 1993

[51] Int. Cl.[6] ..... F26B 13/00

[52] U.S. Cl. ..... 34/233; 34/218; 34/239; 34/487

[58] Field of Search ..... 34/15, 92, 233, 239, 34/218, 219, 107, 443, 487; 432/200, 253

[56] References Cited

U.S. PATENT DOCUMENTS 5,177,878 1/1993 Visser ..... 34/92

*Primary Examiner*—Henry A. Bennet

*Attorney, Agent, or Firm*—Mark E. Courtney; Robby T. Holland; Richard L. Donaldson

[57] ABSTRACT

The invention is directed to a manifold 10 that is used in conjunction with a die attach cure station for providing a "quick cure" of the die mount adhesive, and for forcing contaminants away from the semiconductor die 33 surface. The manifold has an air put port 21 directly above the semiconductor die. Forced air is directed through the port. At each side of the forced port are vacuum ports 20,22 through which a vacuum is applied to draw air and heated die attach contaminants from the die surface. Air is also drawn from below and around the die mounting area to provide a stream of air that is drawn into the vacuum ports.

8 Claims, 6 Drawing Sheets

Quick Cure Exhaust Manifold
L9 Taguchi Test Matrix

| Vaccum | Air | Temperature | Time | %Carbon |
|---|---|---|---|---|
| None | 0 | 170 | 20 | 57.5 |
| None | 15 | 210 | 30 | 74.6 |
| None | 30 | 250 | 40 | 55.4 |
| Half | 0 | 210 | 40 | 54.9 |
| Half | 15 | 250 | 20 | 59.7 |
| Half | 30 | 170 | 30 | 57.9 |
| Full | 0 | 250 | 30 | 55.0 |
| Full | 15 | 170 | 40 | 40.7 |
| Full | 30 | 210 | 20 | 59.7 |

FIGURE 4

Analysis of Variance (ANOVA) for
Quick Cure Exhaust Manifold

| Factor | DF | Sum of Squares | Mean Squares | F | % Contribution |
|---|---|---|---|---|---|
| Vacuum | | | | | |
| Linear | 1 | 171.74 | 171.74 | 700.98 | 28.50 |
| Quadratic | 1 | 0.245 | 0.245 | - | - |
| Air | | | | | |
| Linear | 1 | 5.23 | 5.23 | 21.35 | 0.83 |
| Quadratic | 1 | 5.12 | 5.12 | 20.897 | 0.81 |
| Temperature | | | | | |
| Linear | 1 | 32.67 | 32.67 | 133.35 | 5.39 |
| Quadratic | 1 | 151.32 | 151.38 | 617.88 | 25.13 |
| Time | | | | | |
| Linear | 1 | 111.80 | 111.80 | 456.33 | 18.55 |
| Quadratic | 1 | 123.25 | 123.25 | 503.06 | 20.45 |
| Residual | 1 | 0.245 | 0.245 | | 0.34 |
| Total | 9 | 601.435 | | | 100.0 |

Figure 5

Effects Table for Quick Cure Exhaust Manifold

| Level | Vacuum | Air | Temperature | Time |
|---|---|---|---|---|
| Low | 62.5 | 55.8 | 52.0 | 59.0 |
| Mid | 57.5 | 58.3 | 63.1 | 62.5 |
| High | 51.8 | 57.7 | 56.7 | 50.3 |
| Linear Effect | -10.7 | 1.87 | 4.7 | -8.6 |
| Quadratic Effect | -0.35 | -1.6 | -8.7 | -7.9 |
| Best Case Setting | High | Low | Low | High |

Figure 6

QUICK CURE EXHAUST MANIFOLD

FIELD OF THE INVENTION

This invention relates to semiconductor processing, and more particularly to an exhaust manifold for use with forced air and a vacuum to remove any contaminants out-gassed from epoxy die attach paste during cure.

BACKGROUND OF THE INVENTION

The semiconductor die mounting process involves dispensing a small amount of die attach paste to the leadframe bar pad before mounting the individual device to the bar pad. The die attach paste is then cured by heat in order to insure proper adhesion of the device to the leadframe. Die attach pastes presently being used require a cure time in the range of 1–2 hours at a temperature of approximately 250 degree Centigrade.

"Quick Cure" epoxies used as the die attach paste typically out-gases solvents during the cure process. If there is not proper ventilation during the curing period, contaminants from the out-gassed products can be deposited on the surface of the semiconductor device. Reliability of the assembled semiconductor device is adversely affected by any contaminants on the surface of the device.

SUMMARY OF INVENTION

The invention is directed to a manifold that is used in conjunction with a die attach cure station for providing a "quick cure" of the die mount adhesive, and for forcing contaminants away from the semiconductor die surface. The manifold has an air output port directly above the semiconductor die. Forced air is directed through the port. At each side of the forced port are vacuum ports through which a vacuum is applied to draw air and heated die attach contaminants away from the die surface. Air is also drawn from below and around the die mounting area to provide a stream of air that is drawn into the vacuum ports.

The exhaust manifold for use in semiconductor processing, comprising: a manifold housing; an air output channel in said housing; and two air exhaust channels in said housing adjacent said air output port.

The method for using the exhaust manifold in quick curing semiconductor die attach adhesive, when attaching the semiconductor die to a lead frame mount pad, and preventing out-gassed contaminates from the heated adhesive from depositing on the surface of the die, comprising the steps of: positioning the semiconductor die under an exhaust manifold; directing a stream of air onto the surface of the semiconductor die through a first port in the manifold; and drawing a vacuum through at least one vacuum port adjacent to and/or encircling said first port in said manifold to provide air flow onto and away from the surface of said semiconductor die.

The technical advance represented by the invention, as well as the objects thereof, will become apparent from the following description of a preferred embodiment of the invention when considered in conjunction with the accompanying drawings, and the novel features set forth in the appended claims.

BRIEF DESCRIPTION OF THE DRAWINGS

FIG. 4 is a table showing a test matrix for the Exhaust Manifold;

FIG. 5 is a table showing an analysis of variance;

FIG. 6 is a table showing an Effects Table for the Exhaust Manifold; and

DESCRIPTION OF A PREFERRED EMBODIMENT

Figure 1:
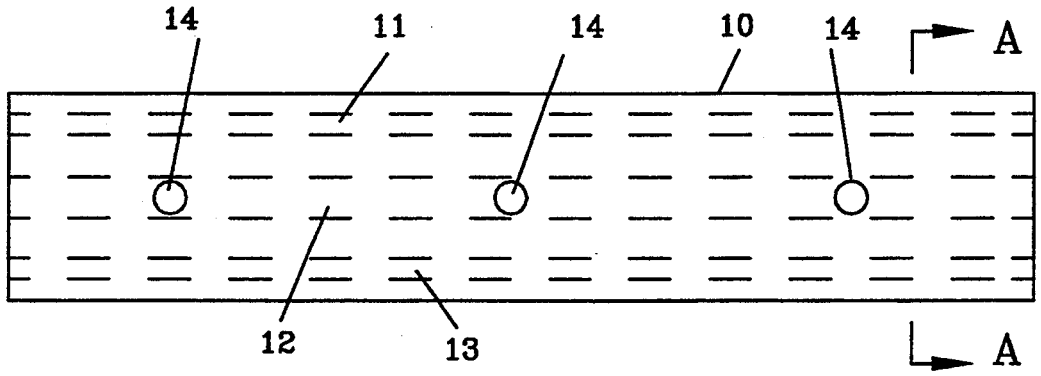
FIG. 1 is a top view of the Exhaust Manifold of the present invention.

FIG. 1 is a top view of the exhaust manifold 10. Manifold 10 has three channels or air passage ways 11, 12 and 13 extending the length of the exhaust manifold. Also shown are three exhaust ports 14, 15 and 16 that allow air to flow from channel 12 to an exhaust vent through a vacuum system, as hereinafter explained.

Figure 2:
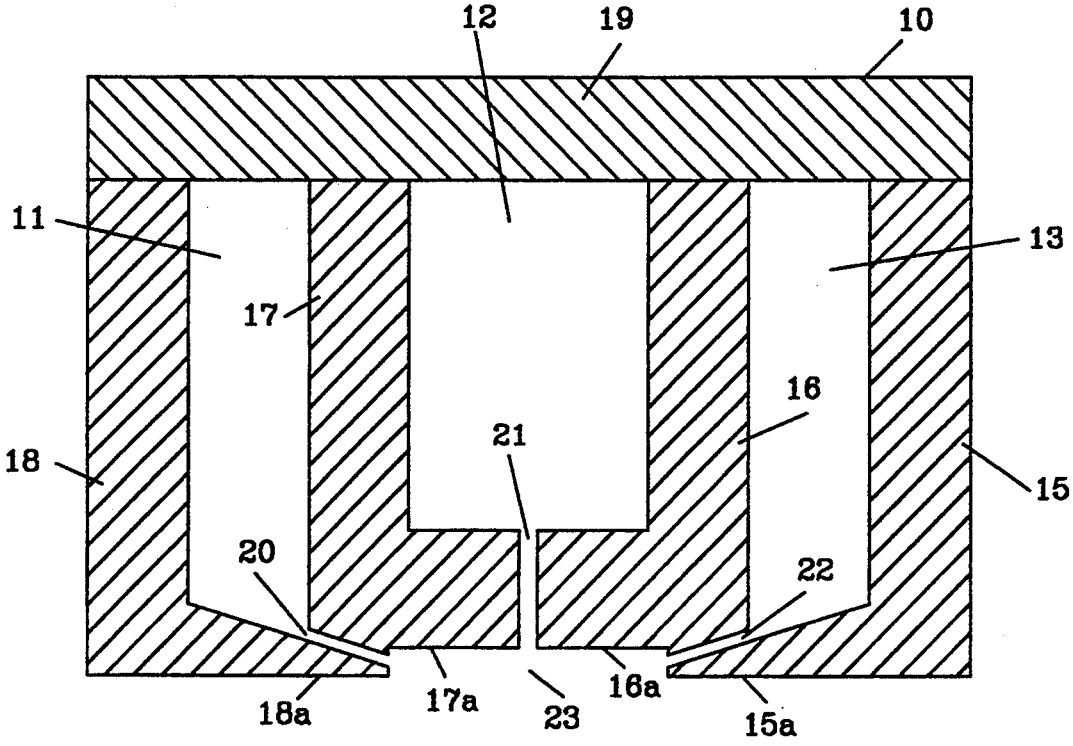
FIG. 2 is across-sectional view of the Manifold taken through section A—A of FIG. 1.

FIG. 2 is a cross-section view of the exhaust manifold taken through section A—A of FIG. 1. Internally, the exhaust manifold has four L-shaped walls 15, 16, 17 and 18 that extend from top plate 19. The outer walls of the manifold are walls 15 and 18. Two internal walls are walls 16 and 17. Each of the walls are generally L-shaped such that the lower leg 15*a* of wall 15 extends partially under inner wall 16, and lower leg 18*a* of wall 18 partially extends under inner wall 17. Lower leg 15*a* and inner wall 16 form an air channel 22 into air channel 13. Lower leg 18*a* and inner wall 17 form an air channel 20 into channel 11.

Inner wall 16 and inner wall 17 each extend toward each other, and form an air channel 21 adjacent lower legs 16*a* and 17*a*.

Each of Channels 20, 21 and 22 open at one end on a common port 23. Port 23 is the exhaust intake area of exhaust manifold 10, and is used in conjunction with a forced air stream and a vacuum to direct out-gassed contaminants away from the surface of a semiconductor die during the adhesive curing cycle, as will be explained and illustrated with reference to FIG. 3.

The exhaust channels 20 and 22 may be a single channel encircling the edges of port 23.

Figure 3:
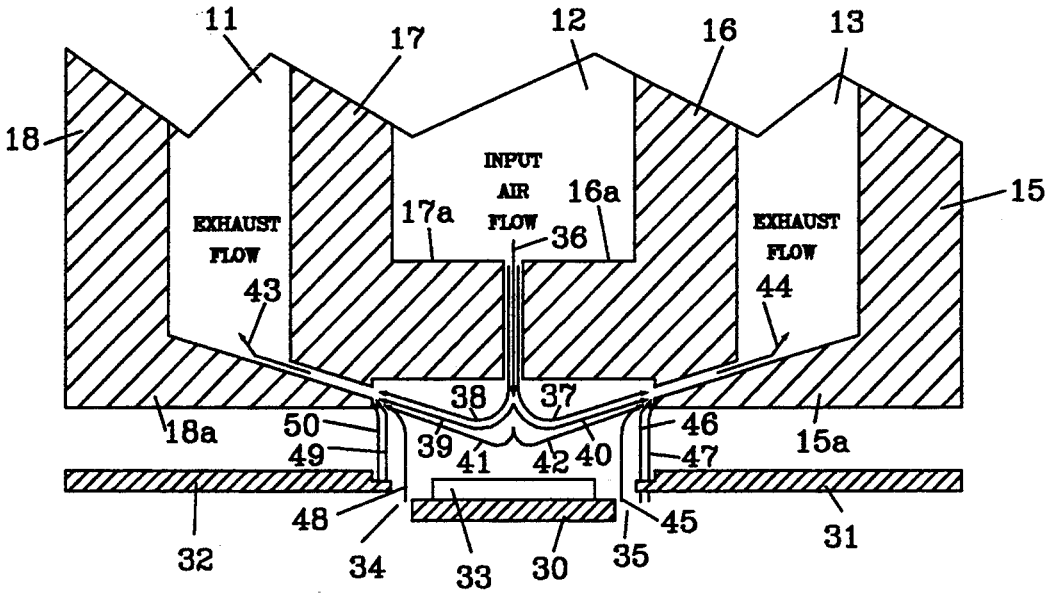
FIG. 3 is a partial, close-up view of the cross-section view of FIG. 2, showing air flow.

FIG. 3 is a partial view of the cross-section view of FIG. 2, and a semiconductor device and leadframe. Lead frame mount pad 30 has a semiconductor die 33 mounted on its upper surface. A die mount adhesive (not illustrated is between die 33 and mount pad 30. It is necessary to heat the mount pad,and die to cure the adhesive to ensure a strong bond between the die and mount pad. During the heating or curing process, contaminants are out-gassed from the adhesive and may settle on the top of die 33, adversely affecting the surface of the die.

The lead frame leads 31 and 32, die mount pad 30 and die 33 are mounted under exhaust manifold 10 just below exhaust intake port 23 (FIG. 2 ). A positive air pressure is directed into channel 12 and is directed through channel 21 as indicated by arrow 36.

A vacuum is applied to channels 11 and 13 which causes air to be drawn into channel 11 through channel 20, and into channel 13 through channel 22. Air flow in channel 20 is indicated by arrow 43, and air flow in channel 22 is indicated by arrow 44.

The vacuum applied to channels 11 and 13 also draws air from beneath and around die mount 30 and die 33 as indicated by arrows 45, 46, 47, 48, 49 and 50. The interaction between the air stream indicated by arrow 36 and the vacuum pulling air though channels 20 and 22 directs air onto and away from the center of die 33, causing an air flow away from the surface of die 33, preventing any out-gassed contaminants from the curing adhesive to reach the surface of die 33, and causing the air to flow into exhaust channels 11 and 13. Arrows 37, 38, 39, 40, 41 and 42 show the air flow downward against die 33 and outward from the center of the die, preventing any contaminants from settling on the die surface.

In the process of securing the die to the lead frame mount pad, adhesive is applied to the die and/or mount surface, and moved under the exhaust manifold. Heat is applied to cure the adhesive. Air is forced thought the air channel 21, while a vacuum is applied to channels 11 and 13. Out-gassed contaminants are prevented from settling on the surface of the die by the air steam directed toward the die, and by the vacuum pulled through channels 20 and 22 above and to each side of the mounted die. The die and lead frame are removed after the adhesive has cured. The exhaust manifold can be installed at an in-line cure process station, along the semiconductor process line.

In order to evaluate the effectiveness of the Quick Cure Exhaust Manifold, a designed experiment was performed. The four factors of vacuum, air, temperature, and time were varied to determine the contribution of each factor to reduce the contamination level on the surface of the die. An L9 Taguchi designed experiment was chosen as the test matrix. The results are shown in the table of FIG. 4. This matrix allows for calculation of an Analysis of Variance (ANOVA) table for each of the four factors. A surface analysis was performed on the semiconductor die of each test group to determine the level of carbon present after cure. The percent carbon present on the die surface was the response used to evaluate the four test factors in the test matrix. The level of carbon present was an indication of the contamination on the die surface after cure.

The ANOVA results are illustrated in the table in FIG. 5. the results shows that vacuum, cure temperature, and cure time all had significant impact on the level of carbon present on the die surface. The forced air was found to have some impact on the contamination level, but was not as significant as the vacuum.

The Effects Table, FIG. 6, numerically indicates the effect that each factor has upon the variance. Also shown is the best case setting for each factor based upon the Effects Table results. the Effects Table is based on the response of percent of carbon on the surface of the die after cure. For this response, lower is better.

Orthogonal polynomials were used to lay out an equation which simulates the manifold cure process. the data from the Taguchi test matrix was the basis for the process equation. This equation was then used to determine carbon levels over a range of cure temperatures. Cure time was also varied. Vacuum was set at full force and forced air was set at zero, corresponding to the results shown in the ANOVA table.

Figure 7:
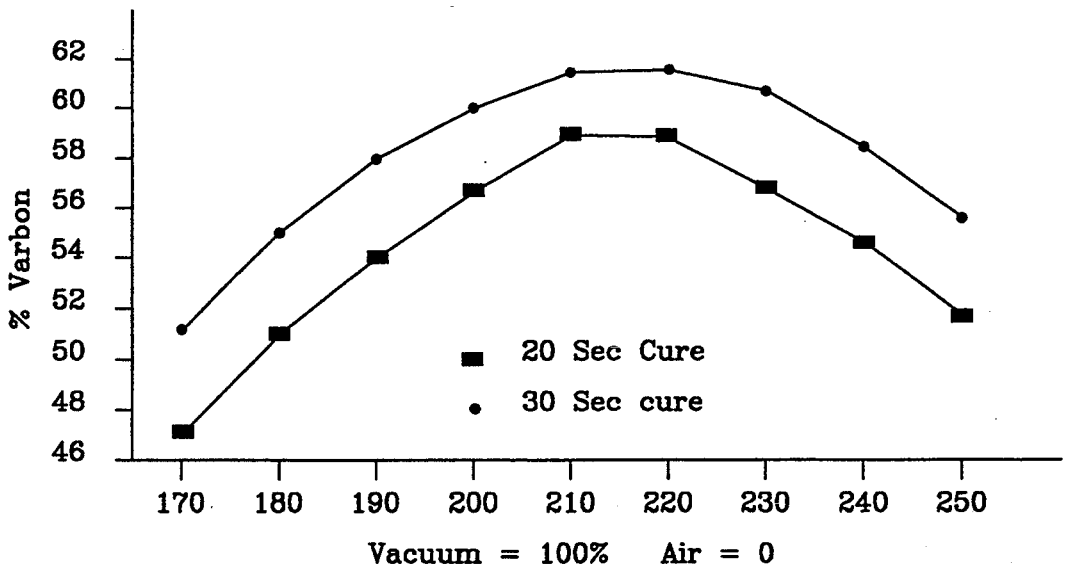
FIG. 7 is a chart showing percent of carbon vs vacuum applied to the Exhaust manifold.

FIG. 7 is a plot showing the temperature at which the minimum level of surface contamination occurs. The results of the experiment indicate the factors which have a strong impact on the surface contamination seen with cure of the epoxy mount compound. The analysis also indicates that the Quick Cure Manifold has positive impact on reducing contamination levels when the factor levels are optimized.

What is claimed

1. An exhaust manifold for use in semiconductor processing for drawing contaminants away from an exposed surface of a semiconductor die mounted on a leadframe mounting pad, comprising:

a manifold housing positioned above and adjacent to said mounted semiconductor die;

an air input channel in said housing for directing air through said housing onto the exposed surface of said semiconductor die: and two air exhaust channels in said housing adjacent said semiconductor die for drawing air away form and around the exposed surface and side of said semiconductor die.

2. The exhaust manifold according to claim 1, wherein said manifold housing includes a top, bottom and two sides, and wherein said air input channel is connected to the bottom side of said housing through a first channel, and said two exhaust channels is connected to the bottom said of said housing through second and third channels.

3. The exhaust manifold according to claim 2, wherein said first, second and third channels open to the bottom side of said housing at an exhaust intake port.

4. The exhaust manifold according to claim 1, wherein said air input channel is connected to an air channel directing air from said air input channel out of said manifold housing.

5. The exhaust manifold according to claim 1, wherein said two air exhaust channels draw air from outside said manifold housing into said manifold housing.

6. An exhaust manifold, which is positioned above a semiconductor die mounted on a lead frame, for removing contaminants which are out-gassed during curing of an adhesive securing the semiconductor die to a lead frame pad, comprising a manifold housing having top and bottom surfaces;

a first opening in the bottom surface of said manifold positioned adjacent to and above a semiconductor die to be cured for directing a stream of air on to a center area on the surface of said semiconductor die;

second and third openings in the bottom surface of said manifold adjacent to and at least partially surrounding said first opening for drawing air into said exhaust manifold when a vacuum is applied to said manifold;

whereby the air stream directed to the surface of said semiconductor die and the air drawn into said second and third openings cause air to flow outward from the center area of said semiconductor die preventing out-gassed contaminants from settling on the die surface during adhesive curing.

7. The exhaust manifold according to claim 6, wherein said second and third openings form a single opening encircling said first opening.

8. The exhaust manifold according to claim 6, including a fourth opening to introduce air into said manifold and out said first opening, and a fifth opening in said manifold for drawing a vacuum in said manifold and drawing air through said second and third openings.

* * * * *